United States Patent [19]

Bérubé et al.

[11] Patent Number: 4,765,245

[45] Date of Patent: Aug. 23, 1988

[54] FIRING PIN AND SAFETY AND ARMING MECHANISM FOR A PENETRATING WARHEAD

[75] Inventors: Gilles Bérubé, Neufchatel; Ghislain Dumas, Duberger, both of Canada

[73] Assignee: Her Majesty the Queen in right of Canada, Canada

[21] Appl. No.: 21,589

[22] Filed: Mar. 2, 1987

Related U.S. Application Data

[63] Continuation of Ser. No. 763,608, Aug. 8, 1985, abandoned.

[30] Foreign Application Priority Data

Dec. 3, 1984 [CA] Canada ..... 469142

[51] Int. Cl.[4] ..... F42C 15/24

[52] U.S. Cl. ..... 102/251; 102/255

[58] Field of Search ..... 102/235, 233, 231, 251, 102/254, 232, 238, 244, 255

[56] References Cited

U.S. PATENT DOCUMENTS

| | | | |
|---|---|---|---|
| 2,392,884 | 1/1946 | Semple | 102/235 |
| 2,741,183 | 4/1956 | Graumann et al. | 102/244 |
| 2,789,507 | 4/1957 | Apotheloz | 102/232 |
| 2,812,714 | 11/1957 | Wheatley et al. | 102/235 |
| 4,230,042 | 10/1980 | Popovitch | 102/233 |
| 4,406,225 | 9/1983 | Backstein et al. | 102/235 |
| 4,440,085 | 4/1984 | Rossmann et al. | 102/235 |

FOREIGN PATENT DOCUMENTS

| | | | |
|---|---|---|---|
| 2232167 | 1/1973 | Fed. Rep. of Germany | 102/238 |
| 1122561 | 4/1955 | France | 102/235 |
| 1113236 | 1/1959 | France | 102/255 |
| 2068088 | 8/1981 | United Kingdom | 102/235 |

OTHER PUBLICATIONS

M. Webster, Webster's Ninth New Collegiate Dictionary, 1985, p. 934.

*Primary Examiner*—Stephen C. Bentley
*Assistant Examiner*—Stephen M. Johnson
*Attorney, Agent, or Firm*—Stevens, Davis, Miller & Mosher

[57] ABSTRACT

A firing assembly for a hard target penetrating warhead is described. The firing assembly includes a safety and arming device with a truncated rotor that is normally retained in a safety position by its setback weight. On acceleration, the setback weight releases the rotor for rotation into a firing position where a pyrotechnical train carried by the rotor is aligned with the firing pin. To prevent over penetration of the pyrotechnical train by the firing pin on high deceleration, the firing pin has a striker with a radial flange that is captive in a chamber in the striker carrier. To prevent retrograde rotation of the rotor to its safety position or high deceleration of the warhead, such as in penetrating a hard target, the bore in the rotor accommodating the pyrotechnical train is chamfered at the entrance end to provide a camming surface that can be engaged by a tapered face on the front of the firing pin. This allows the firing pin to cam the rotor back into position when it has become displaced. The rotor itself is supported in place by a support block engaging the front face of the rotor.

4 Claims, 3 Drawing Sheets

FIRING PIN AND SAFETY AND ARMING MECHANISM FOR A PENETRATING WARHEAD

Figure 1:
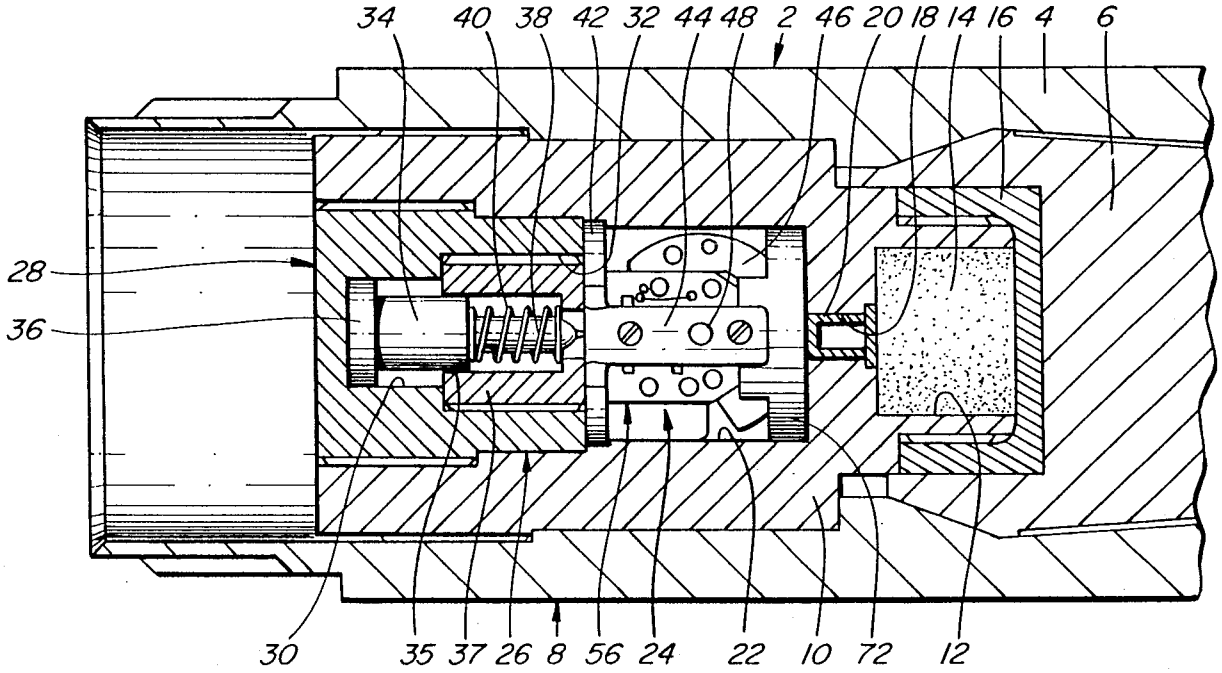

This application is a continuation of application Ser. No. 763,608, filed 8/8/85, now abandoned.

The present invention relates to a firing assembly for a warhead and more particularly to such an assembly for a warhead for penetrating hard targets.

High explosive warheads contain firing assemblies including safety and arming devices for preventing accidental firing of the warhead. The main part of the conventional safety and arming mechanism is an eccentrically mounted rotor that contains a pyrotechnical train. In the safe position of the device, the pyrotechnical train is maintained out of line with a firing pin in the warhead. Under acceleration, the rotor is released and, because of its eccentric mounting, it rotates bringing the pyrotechnical train into line with the firing pin and the rest of the pyrotechnical system. On impact with the target, the inertia of the firing pin carries it forward against a primer in the pyrotechnical train to fire the warhead.

While this known mechanism has been used satisfactorily for some time, it is not suitable for use with a warhead intended to penetrate a hard target and fire after penetration. The problem is the high deceleration encountered during penetration. This is sufficient to damage the relatively delicate safety and arming device, and to prevent its proper operation, either through over-penetration of the firing pin, which destroys the primer and causes the pyrotechnical delay to burn instantaneously, or through reverse rotation of the rotor out of its firing position. Attempts to design other firing mechanisms that will work under these severe conditions have not been successful.

The present invention is concerned with the modification of the existing firing assembly to suit it for use in a penetrator warhead for hard targets.

According to the present invention there is provided a firing assembly for a hard target penetrating warhead comprising:

a safety and arming device with a rotor, means mounting the rotor for rotation about an eccentric axis, safety means normally preventing rotation of the rotor out of a safety position and means responsive to launching acceleration of the warhead for disabling the safety means and permitting the rotor to move from the safety position to an armed position in response to said launching acceleration;

a pyrotechnical train carried by the rotor and consisting of a primer, a pyrotechnical time delay and a detonator;

a firing pin assembly including a firing pin movable into engagement with the primer in response to impact decelleration of the warhead, so as to ignite the primer, a striker secured to the firing pin and a radical flange on the striker; and a striker carrier with a shoulder for engaging the flange so as to limit travel of the firing pin into the primer.

The flange on the striker and the shoulder on the striker carrier act to limit the travel of the firing pin so that it will not over penetrate the primer and cause premature firing of the warhead.

To prevent retrograde rotation of the rotor on impact the primer is recessed into a bore in the rotor so that the firing pin, when projected into the primer will act as a lock holding the rotor in place against rotation back into its safety position. This action is enhanced by a tapered leading end on the firing pin and a camming surface at the entrance of the pyrotechnical train bore so that the rotor, when it has started to rotate back to the safety position, can be brought back into line by the firing pin as it advances towards the primer.

The assembly may also be provided with a support block engaging and supporting the rotor on its side opposite the firing pin.

Figure 2:
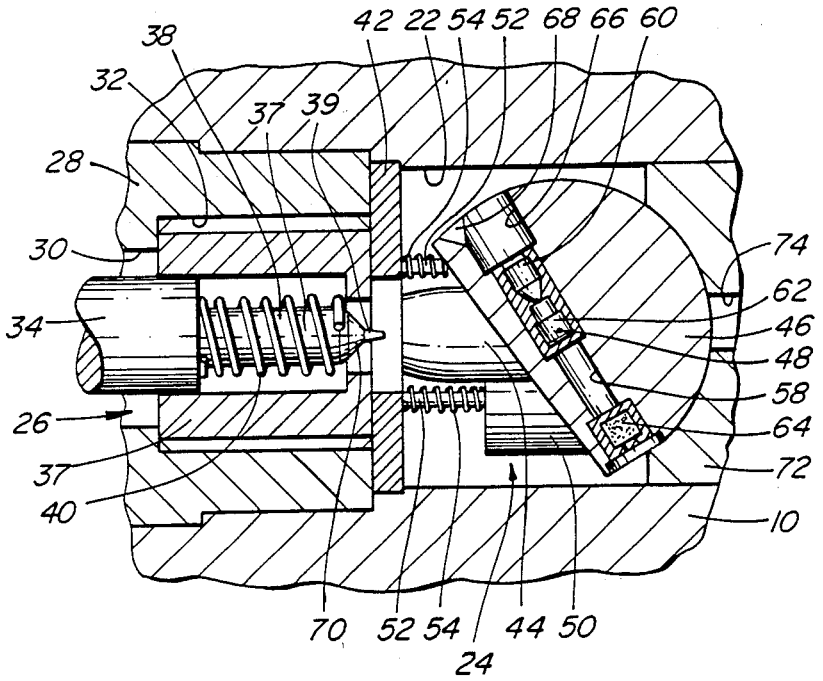
Figure 3:
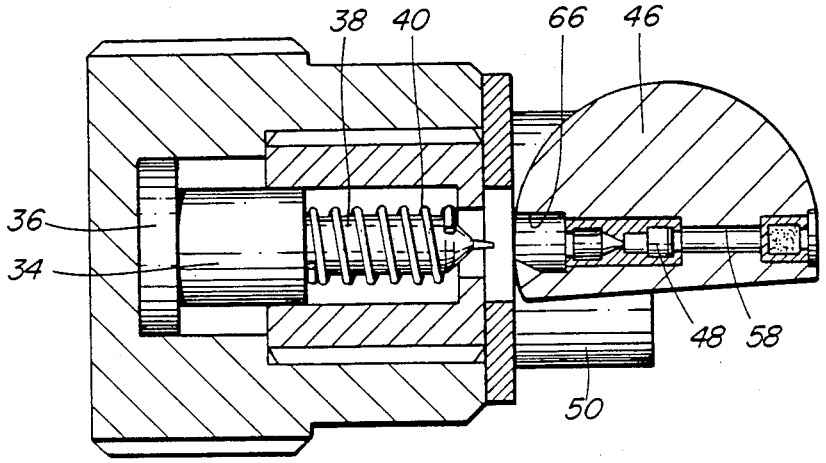
Figure 4:
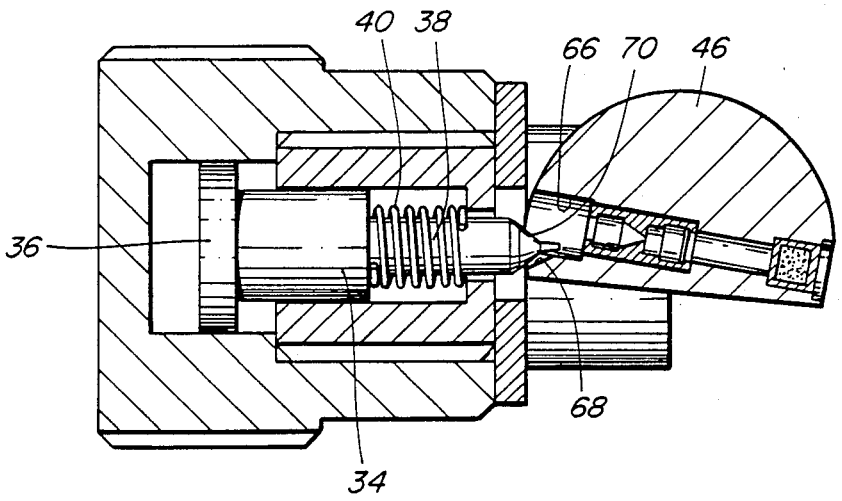
Figure 5:
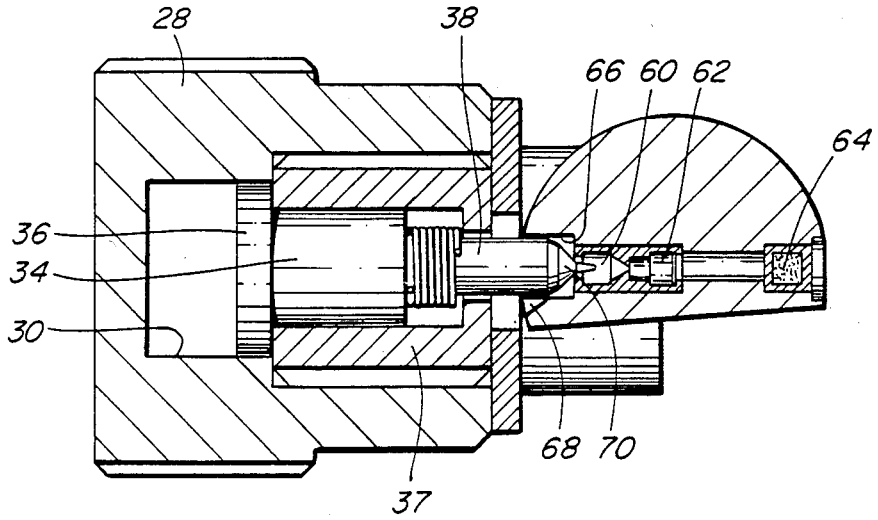

In the accompanying drawings, which illustrate an exemplary embodiment of the present invention:

FIG. 1 is a partial section of a high explosive penetrator warhead incorporating a firing assembly according to the present invention;

FIG. 2 is a view of a portion of FIG. 1 on an enlarged scale, showing the safety and arming mechanism in the safe position; FIG. 3 is a sectional view of the firing assembly showing the safety and arming mechanism in the armed condition; FIG. 4 is a view like FIG. 3 showing the assembly on impact with a hard target; and FIG. 5 is a view showing the assembly with the firing pin in its fully extended position, upon the ignition of the primer.

Referring to the accompanying drawings, and particularly to FIG. 1, there is illustrated a high explosive warhead 2 with a nose cone 4 containing a high explosive charge 6 and firing assembly 8. The firing assembly is mounted in a housing 10, screwed into the aft end of the warhead. A cavity 12 at the leading end of the housing 10 contains a fuze booster 14. A cap 16 is screwed onto the leading end of the housing 2 to close the cavity 12. A bore 18 in the housing leads from the cavity 12 to a chamber 22. The bore 18 contains a lead cap 20 which is a further part of the detonation system. The chamber 22 houses the safety and arming device 24 and the firing mechanism 26.

The firing mechanism is accommodated in a striker carrier 28 that has a central bore 30 at the aft end and a threaded counterbore 32 at the front. A firing pin striker 34 is equipped with a circular flange 36 that rides in the bore 30 between the closed back end of the bore and a shoulder 35 provided by the back end of a retaining bush 37 threaded into the counterbore 32. The main body of the striker 34 slides in the retaining bush 37.

The firing pin 38 is integral to the front end of the striker 34. The firing pin includes a rod 37 projecting forwardly from the striker 34 and a point 39 projecting from the end of the rod. A spring 40 is accommodated between the striker and the forward end of the bush 37 to bias the striker and firing pin towards the back end of the striker carrier.

The safety and arming device 24 is illustrated in FIGS. 1 and 2. As illustrated in those drawings, the device includes a base 42 that is located immediately in front of the firing mechanism 26. The base has two forewardly projecting arms 44 that carry the active parts of the device. Included in these is a rotor 46 in the form of a truncated disc rotatably mounted on an axis 48 that is at the center of the rotor's part circular surface but is eccentric with respect to the center of mass of the rotor. The safety and arming device also includes a setback weight 50 (FIG. 2) that slides forward and aft on two pins 52. The setback weight 50 is biased to a forwards position by coil springs 54 on the pins 52. A clockwork mechanism illustrated generally at 56 in FIG. 1 is geared to the rotor to control its speed of rotation.

The rotor 46 has a stepped bore 58 through it, through its axis of rotation 48. The bore accommodates a primer 60, a pyrotechnic time delay 62 and a detonator 64 in order from the back to the front of the bore. This bore also includes a counter bore 66 adjacent the primer 60, so that the primer is recessed into the rotor. A chamfered camming surface 68 on the counter bore 66 is used for alignment purposes in conjunction with a tapered leading face 70 of the firing pin 38. A support block 72 with an arcuate face engaging and supporting the rotor 46 is mounted on the two arms 44 on the opposite side of the rotor from the firing pin 38.

FIG. 2 illustrates the firing assembly in its condition before launching of the warhead. The rotor 46 is rotated to a position where the bore 58 is out of line with the firing pin 38 and the remainder of the detonating system. The setback weight 50 is at its fully forward position and serves to retain the rotor 46 in the illustrated safety position.

FIG. 3 illustrates the firing assembly after launching of the warhead. The acceleration of the warhead causes the setback weight 50 to compress the springs 54 and to release the rotor 46 for rotation about the axis 48. Because of the eccentric mounting of the rotor 46, the rotor has rotated to a position where the pyrotechnic train is aligned with the firing pin 38. A latch pin (not illustrated) retains the rotor in this position.

FIG. 4 illustrates the condition of the firing assembly when the warhead has struck a hard target and has rapidly decelerated. The inertia of the striker and firing pin carries it forward to compress the spring 40 and to drive the firing pin towards the primer 60. The high deceleration combined with the inertia of the rotor 46 tends to rotate the rotor 46 back towards its safety position. This is countered by the tapered leading face 70 of the firing pin 38 engaging the camming face 68 on the bore 58 through the rotor. Further advance of the firing pin drives the tapered surface 70 up the camming face 68 to return the rotor 46 to its proper firing orientation. In its position of full projection, as illustrated in FIG. 5, the firing pin 38 has penetrated into, but not through, the primer 60. This ignites the primer which in turn ignites the pyrotechnical time delay which burns while the warhead penetrates the target. The delay, would then ignite the detonator 64 which fires the lead cup 20 (FIG. 1), the fuze booster 14 and the warhead explosive charge.

While one embodiment of the invention has been described in the foregoing, it is to be understood that other embodiments are possible within the scope of the present invention. The invention is intended to be limited only by the scope of the accompanying claims.

The embodiments of the invention in which an exclusive property or privilege is claimed are defined as follows:

1. A firing assembly for a hard target penetrating warhead comprising:

a safety and arming device with perpendicular, longitudinal and lateral axes and including a rotor, means mounting the rotor for rotation about the lateral axis, the center of gravity of the rotor being located eccentrically with respect to the lateral axis, a through passage in the rotor transverse to the lateral axis, a pyrotechnical train carried in the through passage in the rotor and consisting of a primer, a pyrotechnical time delay and detonator, the primer being recessed into a counter bore at one end of the through passage, safety means normally preventing rotation of the rotor out of a safety position and means responsive to longitudinal launching acceleration of the warhead for disabling the safety means and permitting the rotor to move from the safety position to an armed position in response to said longitudinal acceleration;

a striker carrier with a longitudinal bore that is aligned with the counter bore in the armed position of the rotor and a shoulder in the longitudinal bore facing away from the counter rotor;

a striker slidable in the bore and having a radial flange engageable with the shoulder;

a firing pin secured to the striker and including a rod with one end secured to the striker and projecting from the striker towards the rotor, the rod being dimensioned to be a sliding fit in the counter bore and having the end opposite the striker tapered to a point that is spaced from the radial flange of the striker by a distance less than the spacing between the shoulder and the pyrotechnical time delay when the rotor is in the armed position; and spring means biasing the striker and firing pin away from the rotor.

2. An assembly according to claim 1, including a chamfered surface at the entrance end of the counter bore to provide a chamfered surface for engagement with the tapered leading end of the firing pin.

3. An assembly according to claim 2, including a support block engaging and supporting the rotor on the side thereof opposite the firing pin.

4. An assembly according to claim 1, including a support block engaging and supporting the rotor on the side thereof opposite the firing pin.

* * * * *